United States Patent [19]

Matimura

[11] Patent Number: 4,555,828

[45] Date of Patent: Dec. 3, 1985

[54] GUIDING SYSTEM FOR MOVABLE SUSPENDED PARTITION WALLS

[75] Inventor: Tugumi Matimura, Osaka, Japan

[73] Assignee: Itoki Kosakusho Co., Ltd., Osaka, Japan

[21] Appl. No.: 604,577

[22] Filed: Apr. 27, 1984

Related U.S. Application Data

[63] Continuation-in-part of Ser. No. 328,629, Dec. 8, 1981, abandoned.

[30] Foreign Application Priority Data

| | | | |
|---|---|---|---|
| Dec. 8, 1980 | [JP] | Japan | 55-173579 |
| May 29, 1981 | [JP] | Japan | 56-82996 |
| Jun. 16, 1981 | [JP] | Japan | 56-93365 |

[51] Int. Cl.[4] ..... E05D 13/02

[52] U.S. Cl. ..... 16/95 R; 16/87 R; 16/102; 49/409; 104/105; 104/130

[58] Field of Search ..... 16/87 R, 87.4 R, 91, 16/93 R, 93 D, 94 R, 94 D, 95 R, 95 W, 95 D, 95 DW, 96 R, 96 D, 96 L, 102; 160/345-347; 104/96, 100, 101, 105, 130-132; 49/409, 410, 411, 412

[56] References Cited

U.S. PATENT DOCUMENTS

| | | | |
|---|---|---|---|
| 2,944,282 | 7/1960 | Greco | 16/87 R |
| 3,076,419 | 2/1963 | Dehne | 104/130 X |
| 3,279,123 | 10/1966 | Genison | 16/87 R X |
| 3,593,668 | 7/1971 | Adams | 104/105 X |
| 3,628,462 | 12/1971 | Holt | 104/105 |
| 3,708,916 | 1/1973 | Karp, Jr. et al. | 49/409 |
| 3,830,162 | 8/1974 | Marten | 104/105 |
| 3,843,995 | 10/1974 | Merrill | 49/409 X |
| 3,913,491 | 10/1975 | Auer, Jr. et al. | 104/105 X |
| 4,214,535 | 7/1980 | Gerhard | 104/130 X |
| 4,258,278 | 8/1981 | Mitchell | 104/130 X |

FOREIGN PATENT DOCUMENTS

| | | | |
|---|---|---|---|
| 54-149105 | 11/1979 | Japan | 104/130 |
| 1415157 | 1/1971 | United Kingdom . | |

*Primary Examiner*—Fred Silverberg

*Attorney, Agent, or Firm*—Birch, Stewart, Kolasch & Birch

[57] ABSTRACT

A guiding system for movable suspended partition walls comprising a main guide rail and two or more branch guide rails each extending from one side of the main guide rail to define two or more directional change points, a plurality of retainers movably disposed within the guide rails and suspending therefrom a plurality of partition walls, and guide members to select directions of movement of the retainers so that selected one or ones only among the retainers can move from the main guide rail into a selected one of the branch guide rails or vice versa without bringing the retainers to a stop at the directional change points.

7 Claims, 18 Drawing Figures

GUIDING SYSTEM FOR MOVABLE SUSPENDED PARTITION WALLS

BACKGROUND AND SUMMARY OF THE INVENTION

This is a continuation-in-part of my copending application Ser. No. 328,629, filed Dec. 8, 1981, now abandoned.

This invention relates to improvements in a guiding system for mavable suspended partition walls.

The guiding system for movable suspended partition walls is known as comprising hollow guide rails, each having a longitudinal open passageway on the underside thereof, arranged on the celling of a room or the like, and suspenders each suspending a partition wall movable about a vertical axis and having a retainer inserted into and movable along the hollow guide rail. For the purpose of guiding a plurality of such suspended partition walls in order to stack them, for example, at the corner of a room or in order to partition a room in criss-cross manner or into a T-shape or other shape by means of such partition walls, it is necessary to bend the hollow guide rail halfway into an L-shape, or to connect a couple of the hollow guide rails to form an L-shape, or to connect two or more of the rails to form a criss-cross or T or Y-shape, so as to smoothly changes the course of each retainer without it dropping off the hollow guide rail at the afore-said bend or intersection. Thus, several attempts have been made and proposed as disclosed, for example, in German Patent Specification Nos. 20 54 888 and 21 45 793, and U.S. Pat. No. 3,708,919.

In each of these prior art apparatuses, a plurality of retainers, which suspend therefrom partition walls, are movably engaged with guide rails including a main guide rail and one or more branch guide rails. However, none of these prior art apparatuses is provided with means to select directions of movement of the retainers so that selected one or ones only among the retainers can move from the main guide rail into one of the branch guide rails or vice versa at each of the directional change points. Consequently, these prior art apparatuses are not very convenient in use because the retainer must be brought to a stop at the L-shaped bend or criss-cross intersection before being guided into the intended hollow guide rail by shuffling back and forth. Further, the retainer tends to over run or stray from the criss-cross or Y-shaped intersection along a direction other than that intended, resulting in the need for the retainer to be first brought back and then guided to the direction of the intended rail by pushing and pulling. Thus, the prior art apparatuses do not provide automatic change of the forwarding direction of the retainer at each bend or intersection.

On the other hand, Japanese Utility Model Publication No. 54-11423 ( published May 23, 1979) also discloses an apparatus which comprises a plurality of retainers each of which is provided with a pair of guide rollers free to rotate about a respective vertical axis and supported on the upperside in the front and rear thereof as viewed in the advance direction of the retainer, and in addition a pair of guide rails arranged at left and right inside the bend of the hollow guide rail to guide the left and right sides of the front and rear rollers in a pair, so that the direction of the retainer is changeable with the guide rails and the front and rear rollers in a pair that are cooperative with the rails. However, this prior art apparatus, which requires a pair of guide rails at left and right, is not only incapable of selectively changing the direction of two or more partition walls of the same construction, one into one hollow guide rail and another into another hollow guide rail for example at the criss-cross or T-shape intersection, but also necessitates that the pair of guide rails on the left and right should be arranged to cover a distance long enough from the front through the rear along the advance direction. Furthermore, the construction of the retainer is intricate, and in addition, the guide rollers being guided by the guide rails, changing direction unavoidably meets with a greater resistance preventing movement of the partition walls with a light force.

Also in British Patent Specification No. 1 415 157, there is disclosed an appartus for guiding a plurality of retainers, which suspend therefrom partition walls, are movably engaged with a main guide rail and a branch guide rail, wherein means is provided to select directions of movement of the retainers so that selected ones only among said retainers can move from the main guide rail into the branch guide or vice versa. According to this apparatus, however, the afore-said means consists of a forked guide means and two types of guided members arranged so as to alternatively cooperate with the guide means. As a matter of course, this prior art apparatus is not applicable to such a system where two or more branch guide rails extend from a main guide rail.

The present invention seeks to eliminate the above mentioned disadvantages.

According to the present invention, there is provided a guiding system for movable suspended partition walls, comprising: at least one hollow main guide rail; at least two spaced, hollow branch guide rails each extending at an angle and to one side of the main guide rail; the main and branch guide rails defining at least two directional change points therebetween; each of the main and branch guide rails having a longitudinally extending open passageway on the underside thereof; a plurality of retainers disposed within the guide rails so as to be freely movable longitudinally along the open passageway, and suspending therefrom a plurality of partition walls each of which is movable about a vertical axis; means to select directions of movement of the retainers so that selected one or ones only among the retainers can move from the main guide rail into one of the branch guide rails and vice versa at each of the directional change points; the afore-said means having a plurality of guide means one of which is selectively disposed at each of the directional change points; a plurality of upstanding guided members mounted on the retainers, in such a manner that a selected one of the guided members is disposed on one side of a vertical swivel axis of each of the retainers; each of the guide means having a first guiding part which is contacted by an inner side portion (portion adjacent to a center line of the open passageway) of a pre-selected guided member, and a second guiding part which is contacted by a front portion (as viewed in the direction of advance of said retainers) of the pre-selected guided member, when the pre-selected guided member comes into contact with a cooperating guide means, wherein each of the guided members has such a predetermined inherent height (vertical length) that permits its contact with a pre-selected one only among the guide means at a pre-selected directional change point and its free passing underneath any other preceding directional change point, and a level of contact between the guided members and the guide means at a preceding directional change point is higher than that at a subsequent directional change point.

It is, therefore, an object of the invention to substantially eliminate the above-discussed disadvantages in the conventional apparatus or system.

Another object of the invention is to provide an improved guiding system for movable suspended partition walls, which is provided with at least one main guide rail and at least two spaced brach guide rails defining at least two directional change points therebetween, and means to select directions of movement of a plurality of retainers suspending therefrom a plurality of partition walls, so that selected one or ones only among the retainers can move from the main guide rail into one of the branch guide rail, without bringing the partition walls to a stop at each of the directional change points.

A further object of the invention is to provide an improved guiding system for movable suspended partition walls, which is provided with a plurality of retainers each of which is prevented from oscillating or rotating within a straight open passageway, promoting the performance of its straight advancement.

Other objects, features and advantages of the invention will become more fully apparent from the detailed description given hereinafter in connection with the accompanying drawings. It should be understood, however, that the detailed description and specific examples, which indicate preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

Figure 1:
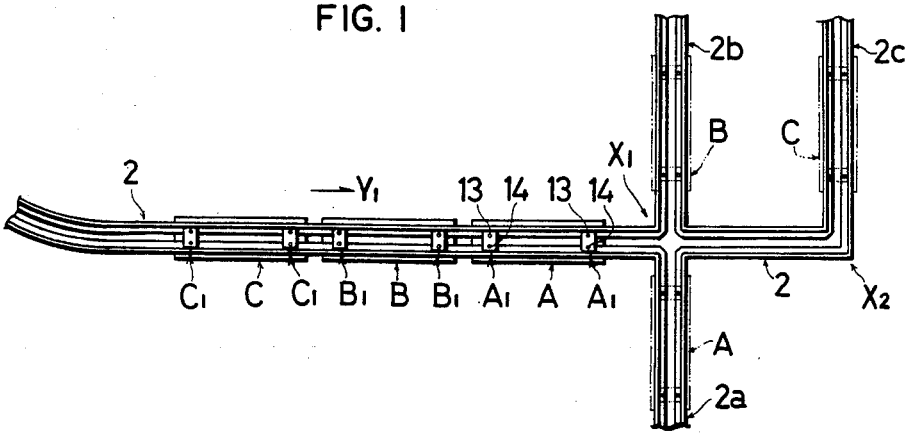
FIG. 1 is a top plain view showing an arrangement of guide rails.
Figure 2:
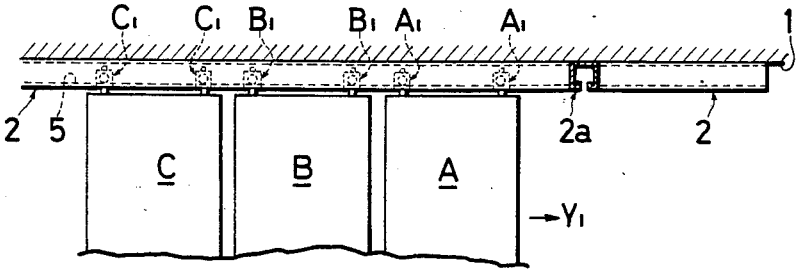
FIG. 2 is a fragmentary side elevation of FIG. 1.

Referring now to the drawings, reference characters A, B and C designate partition walls suspended from a main hollow guide rail 2, which is fixed to the ceiling 1, and movable in the direction of an arrow $Y_1$ in the order A, B and C. As shown in FIG. 1, the main hollow guide rail 2 is provided along its length in the direction of advance of the partition walls with a first directional change point $X_1$ which comprises a branch guide rail **2*a* connected thereto at a right angle on the right of the direction of advance of the partition walls and a branch guide rail 2*b* connected thereto at a right angle on the left, and a second directional change point $X_2$ spaced forward of the change point $X_1$ and comprising an angled part to which a branch guide rail 2*c* is connnected. Each of said guide rails has a hollow, substantially box-shaped cross section comprising left and right side plates 4 depending from a top plate 3 and turned horizontally inwards at the lower end thereof to provide left and right guide tracks 5, 5 the free longitudinally extending edges of which are turned upwards to form a pair of guide flanges 6 having a height $h_1$. An open passageway 7 of a width $h_2$ is provided between the pair of flanges 6**.

The partition wall A is to be directed into the right side guide rail **2*a* at the directional change point $X_1$ the partition wall B into the left side guide rail 2*b* at the directional change point $X_1$, and the partition wall C into the left side guide rail 2*c* at the directional change point $X_2$. Each of the partition walls A. B and C is provided on its upper end, with suspenders $A_1$ and $A_1$, $B_1$ and $B_1$, and $C_1$ and $C_1$. The suspenders on each partition wall are suitably spaced apart towards front and rear ends thereof. Each of the suspenders comprises a vertical suspension bar 8 which extends upwards from the upper end of each partition wall into the inside of the hollow guide rails through the open passageway 7. A retainer generally designated by reference numeral 10 is provided on the upper end of each suspension bar 8 via a thrust bearing 9** free to turn about its axis.

Each retainer 10 is provided with two rollers 11 on opposite sides with respect to its direction of advance along the hollow guide rail. The axis of each roller is horizontal and the lower portion of each roller 11 is in contact with a respective guide track 5, 5 of the hollow guide rails so as to be able to roll therealong. A runner guide 12, perferably formed of plastics or like material, idly bearing the suspension bar 8, is so fixed to the underside of the retainer 10 that the left and right sides of the runner guide 12 face the left and right flanges 6 and 6 respectively with a suitable clearance.

Figure 3:
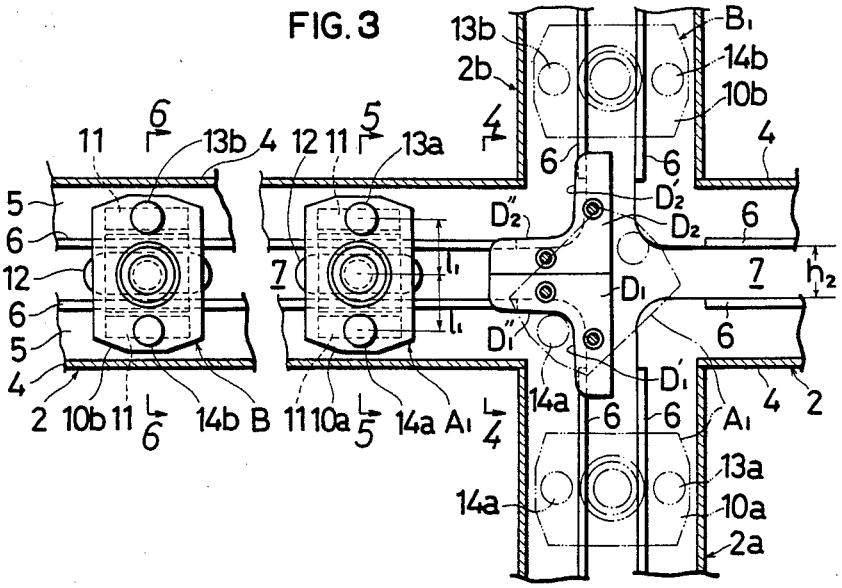
FIG. 3 is a fragmentary section taken along the line 3—3 of FIG. 6, showing a criss-cross intersection of FIG. 1 in detail.
Figure 4:
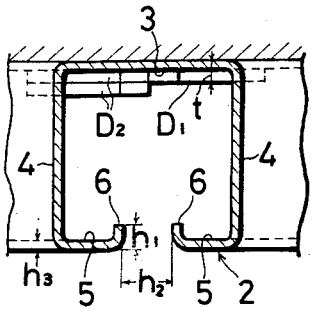
FIG. 4 is a sectional view taken along the line 4—4 of FIG. 3.
Figure 5:
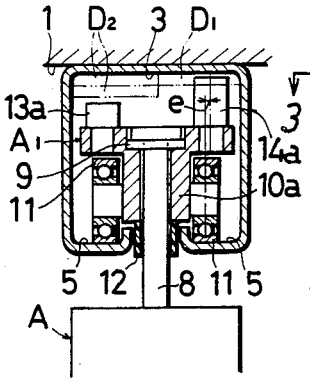
FIG. 5 is a sectional view taken along the line 5—5 of FIG. 3.
Figure 6:
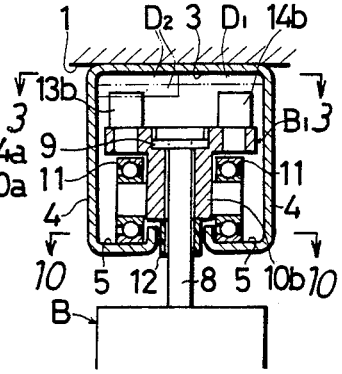
FIG. 6 is a sectional view taken along the line 6—6 of FIG. 3.

Reference numerals 13 and 14 generally designate a pair of guided members which protrude upwards from the upper surface of the retainer 10 on the left and right sides thereof as viewed in the advance direction and which are spaced from the axis of the suspension bar 8 by a suitable distance $l_1$ (FIG. 3). In the particular embodiments illustrated in FIGS. 3 to 10, each of the guided members is in the form of a pin of suitable diameter. Each of the guided members 13 and 14 (13*a*, 14*a* for the suspender $A_1$; 13*b*, 14*b* for the suspender $B_1$; 13*c*, 14*c* for the suspender $C_1$) is offset laterally by a distance e (FIG. 5) with respect to the center of contact between each of the underneath rollers 11 and the guide track 5, but this is not essential.

Reference characters $D_1$, $D_2$ and $D_3$ designate guide members each protruding downwards from the underside of the top plate 3 and provided approximately above the open passageway 7 at a relevant directional change point where the direction of a retainer is to be changed horizontally to the left or right. The guide member $D_1$ comprises a first guiding part $D_1''$ which is contacted by an inner side of the guided member 14*a* adjacent to the center line of the open passageway 7, and a second guiding part $D_1''$, which is contacted by the advancing front of the guided member 14*a*, disposed inside the turning radius of the retainer 10*a* which advances toward the directional change point $X_1$. Likewise, the guide member $D_2$ comprises like guiding parts $D_2'$, $D_2''$, while the guide member $D_3$ comprises like guiding parts $D_3'$, $D_3''$. The guide members provide means to change the direction of the retainers 10 without a stop at an intersection or the like. As shown in FIG. 3 for example, in order to change the direction of the retainer 10*a* of the partition wall A to the right at the first directional change point $X_1$, a sheet of guide plate $D_1$, L-shaped in a plan view, having a thickness t (FIG. 4), is fixed so that the guiding part $D_1'$ on the side of the L-shaped guide member $D_1$ is contacted by the front of the guided member 14*a* arranged on the right side of the advance direction of the retainer 10*a* (inside the turning radius), and the guiding part $D_1''$ is contacted by said guided member 14*a* at the inner side thereof closer to the center line of said open passageway 7, so as to cause the retainer 10*a* to change its direction with an extremely small turning radius. To change the direction of the retainer 10*b* suspending the partition wall B to the left, two sheets of guide plate $D_2$ are stacked at a position back to back with said guide plate $D_1$, and the guiding part $D_2'$ on the side of the L-shaped guide member $D_2$ is contacted by the front of the guide member 13*b* arranged on the left side of the advance direction of the retainer 10*b*, and the guiding part $D_2''$ is contacted by the guided member 13*b* at the inner side thereof closer to the center line of the open passageway 7, so as to cause the retainer 10*b* to turn to the left with an extermely small turning radius. In this connection, the height of the guided member or pin 13*a* on the left side of the advance direction of said retainer 10*a* (i.e. outside of the turning radius) is set to allow the guided member 13*a* to pass freely underneath the guide member $D_2$ which is provided in two layers to guide the retainer 10*b*, and likewise the height of the guided member or pin 14*b*, on the right side of said retainer 10*b* is set to allow it to pass underneath the guide member $D_1$ which is intended for the retainer 10*a*.

Figure 7:
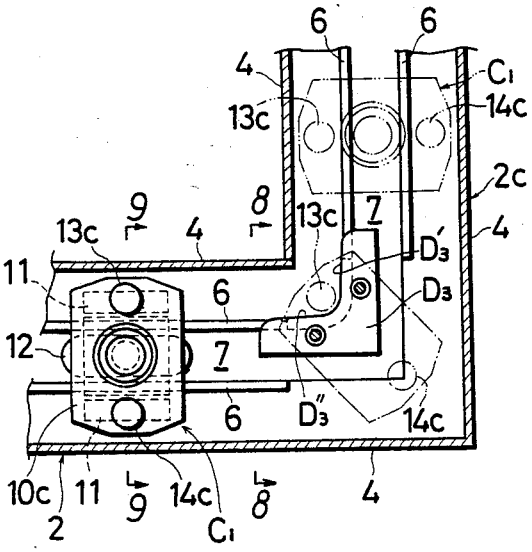
FIG. 7 is an enlarged top plan view, partly in section, showing an angled part.
Figure 8:
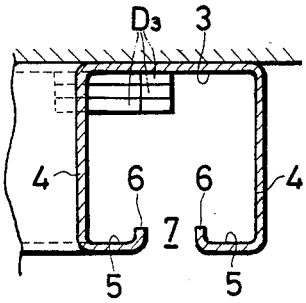
FIG. 8 is a sectional view taken along the line 8—8 of FIG. 7.
Figure 9:
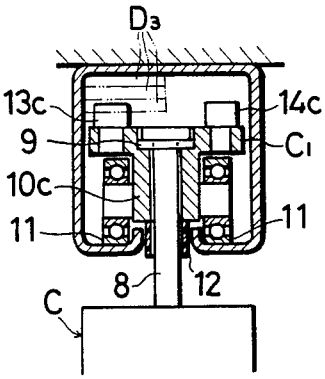
FIG. 9 is a sectional view taken along the line 9—9 of FIG. 7.

As shown in FIG. 7, the second direction change point $X_2$ comprising an L-shaped angle is provided with three stacked sheets of plates $D_3$, L-shaped in plan view, (FIG. 8) so that the advancing front of the guided member or pin 13*c* on the left side of the advance direction of the retainer 10*c* of suspending the partition wall C contacts the guiding part $D_3'$ of the guide member $D_3$, and the inner side of the guided member 13*c* closer to the center line of said open passageway 7 contacts the guiding part $D_3''$ of the guide member $D_3$, thereby changing the direction of the retainer 10*c* to the left to guide the retainer 10*c* into the branch guide rail 2*c*. For advancing the partition wall C straight past the first directional change point $X_1$, the height of the guided member 14*c* on the right of the advance directin of said retainer is set low enough to pass underneath the single guide plate $D_1$ and the height of the guided member 13*c* is set low enough to pass underneath the guide member $D_2$, which is in two layers.

According to the particular construction described hereinbefore, the direction of each of the partition walls A, B and C arranged in a file longitudinally along the main hollow guide rail is changeable without a stop at a pre-set point of directional change with an extremely small radius. Further, a combination of the position of fixing the guide member and the downward height thereof with the heignt of the left and right guided members on each retainer makes it possible to selectively direct the partition walls into the intended hollow guide rail despite there being a plurality of directional change points such as an intersection, angle of the like.

Another embodiment of the system for changing the advance direction of a retainer according to the invention is illustrated in FIGS. 12 to 15. Instead of a guide plate which is L-shaped in plain view, roller type guide members $D_4$, $D_5$ and $D_6$ free to rotate about vertical axes are provided and protrude downwards to more or less the same distance from the top plate 3 of the hollow guide rail over the open passageway 7 at the intersection. The front, as viewed in the advance direction, of a pin-like guided member 14*a* provided on the right side of the advance direction of the retainer 10*a* contacts the side of one of said roller type guide members $D_4$, and the side of the guided member 14*a* closer to the center line of the open passageway 7 contacts the side of the roller type guide member $D_6$, so as to turn the retainer 10*a* to the right. The front, as viewed in the advance direction, of a pin-like guided member 13*b* provided on the left side of the advance direction of the retainer 10*b* contacts the side (guiding part $D_5'$) of the other roller type guide member $D_5$, and the inner side of the guided member 13*b* closer to the center line of the open passageway 7 contacts the side (guiding part $D_6''$) of the roller type guide member $D_6$, so as to turn the retainer 10*b* to the left. In this embodiment again, the height of the guided members 13*a* and 14*b* is set to permit them to pass underneath the other guide members $D_5$ and $D_4$, respectively.

Figure 16:
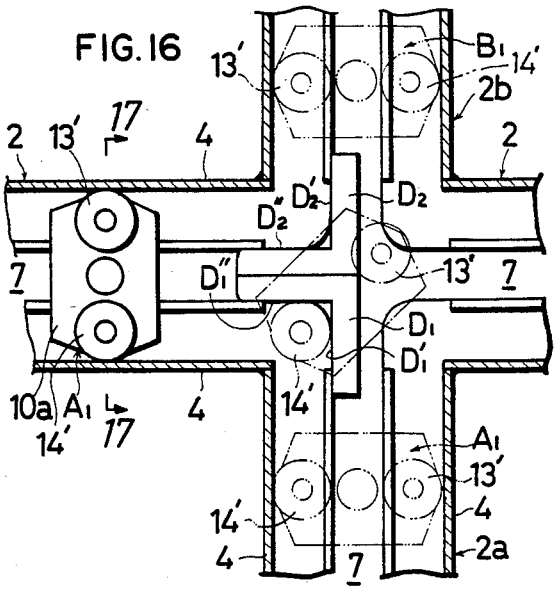
FIG. 16 is an enlarged top plan view, partly in section, showing yet a further embodiment of a criss-cross intersection.
Figure 17:
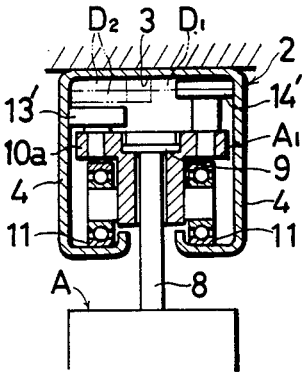
FIG. 17 is a sectional view taken along the line 17—17 of FIG. 16.

In the embodiment shown in FIGS. 16 and 17, instead of the pin-like guided members described above, roller type guided members 13' and 14', each free to rotate about a vertical axis, are provided. The outer sides of the left and right guided members 13' and 14' are arranged to maintain contact with the inside wall of left and right side plates 4, 4 of the hollow guide rails 2, 2*a*, 2*b*. For a guide member at an intersection or the like, guide plates $D_1$ and $D_2$, L-shaped in plan view, are provided back to back. To turn the retainer 10*a* at the intersection to the right of the advance direction for example, the height of the guided member 14' which is located inside the turning radius is elevated as illustrated in the drawings so that the front thereof as viewed in the advance direction contacts the guiding part $D_1'$, of the guide member $D_1$ and the inner side of the guided member 14' closer to the center line of the open passageway 7 contacts the guiding part $D_1''$, causing the retainer 10*a* to change its direction, and the height of guided member 13' which is located outside the turning radius is set low enough to pass through.

Figure 18:
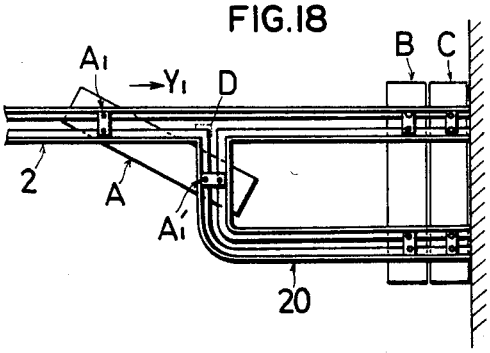
FIG. 18 is a top plan view showing a stacking place of partition walls.

Also it is possible to stack a plurality of movable suspended partition walls at the corner of a room or the like with their major surfaces facing each other. Only one of the front and rear suspenders $A_1$ and $A_1'$ of each partition wall, e.g. suspender $A_1'$ is directed along a branch guide rail 20 by selectively directing, by means of the guide member D, as illustrated in FIG. 18.

Furthermore, the branch guide rails need not form a right angle with the main guide rail but can instead form an acute or obtuse angle therewith, in which case a guide member will be a correspondingly shaped. Further, instead of the rollers 11, 11 adequate means such as spherical rollers may be used so far as they permit smooth running on the guide tracks 5, 5.

As described above, the guiding system comprises a suspender which suspends from its lower end a partition wall movable about a vertical axis, and a retainer movably disposed within a hollow guide rail, the retainer being able to change its direction in a horizontal plane at an angle or intersection of the hollow guide rail. Guided members are provided protruding upwards from the upper side of the retainer at positions suitably eccentric to the vertical axis of the suspender and a guide member is provided at the angle or intersection of the hollow guide rail so that the guide member is contacted by the front as viewed in the advance direction of the guided member and almost simultaneously by the inner side of the guided member closer to the center line of the open passageway along the advance direction when the retainer reaches the directional change point. Therefore, the retainer is prevented from advancing straight on past the angle or intersection of the hollow guide rail, and this makes it unnecessary to being the partition wall to a stop at each directional change point. Moreover, the retainer does not slip sideways out of its turning radius when changing its direction. Further, since the retainer turns around the axis of rotation of the relevant guided member which turns along both of the contact points of the guide members, the radius required for changing the directions of movement of the retainer can be minimized, and, as described above, the retainer is prevented from slipping slideways. Therefore, it is not necessary to provide a wider open passageway area at the angle of intersection and this contributes to changing the direction of the retainer with an extremely small turning radius and to preventing the retainer from dropping off the hollow guide rail at a directional change point.

Furthermore, since the guide member as arranged at a directional change point is only provided with a guiding part which comes into contact with the front of a relevant guided member and another guiding part which comes into contact with the inner side (side closer to the center line of the open passageway) of the guided member, the length of the guide member in the advance direction can be made extremely short by forming a guide member into a pin or roller of circular section. Therefore, after having fixed the hollow guide rails to the ceiling, guide members can be inserted through the open passageway to be easily fixed by screws, and likewise, removal therefrom is also simple. By forming the front of the guided member or the side of guide member into a curved surface, or into such as a roller free to rotate, the contact surface of both is replaced with a line of contact, or is made slippery to ensure a smooth change in the direction. The main hollow guide rail is provided along its longitudinal extent with a first directional change point intersecting with or branching out from the relevant hollow guide rail, and with second, third, fourth and so on of directional change points of intersection, divergence or angle suitably spaced apart in a forward direction. The retainer may be provided with a pair of guided members protruding upwards on the left and right of its central vertical swivel axis as viewed in the direction of advance of the retainer. A guide member is provided on the hollow guide rail at each of said directional change points, and in order that, when the retainer reaches one the derectional change points, the front of the guided member positioned inside the directional change of the retainer is selectively brought into contact with the guide member to change the direction, a level of contact between the guided member and the guide member at each of the directional change points is so set that the subsequent contact level is lower than that of the preceding or the contacting level is gradually lowered in consecutive order. Of the left and right guided member in a pair it is possible to provide each directional change point with a combination of a different level of contact point between the guided member and guide member positioned inside the turning radius of the retainer which is expected to change its direction, and similarly with a combination which prevents the guided members positioned outside the turning radius from coming into contact with the guide member at the relevant directional change point. Arrangement of such a combination in advance being possible at random, any retainer can be selectively directed to change its course into the pre-set direction on the right or left from a plurality of pre-set points of directional change on the hollow guide rails. Therefore, a partition wall suspended from the pre-selected retainer can be extremely easily guided along an intended course. Operation to partition a room into many small compartments is also extremely easy by successively moving a plurality of partition walls from a single hollow guide rail.

Furthermore, the retainer is prevented from oscillating or rotating within the straight open passageway, promoting the performance of its straight advancement, by arranging both sides of the runner guide fixed to the underside of each retainer to face the left and right edges of the open passageway of the guide rails so that the left or right side of the runner guide contacts the left or right edge of the open passageway if the retainer starts to oscillate to the left or right or to rotate therein. However, if the longitudinal length between the front and rear of the runner guide is inceased, the front and the rear of the runner guide as viewed in the advance direction may come into contact with the right or left side of the open passageway at a criss-cross or T-shaped intersection or L-shaped bend (angle) of the guide rails, preventing the retainer from smoothly changing its direction. If the opening width of the open passageway is windened at the intersection or the like in order to avoid this drawback, the rollers which are provided on the retainer at left and right are liable to run off the guide tracks and fall into the open passageway, disturbing their rotation or badly bouncing the partition wall up and down.

The apparatus is able to eliminate the above discussed disadvantages by arranging that the left and right edges of the open passageway have a greater depth between the top and bottom in the straight sections and a smaller depth at the passageway sections with a small turning radius such as an intersection and the like, and the runner guide, fixed to the underside of the retainer, has either the front or rear or the both partially cut away in its lower wall to make the length between the front and rear of the lower part of the retainer shorter than the length between the front and rear of the upper part thereof so that the cutaway part passes through the area of the turning point where the smaller depth is provided between the top and bottom of the left and right edges.

Figure 10:
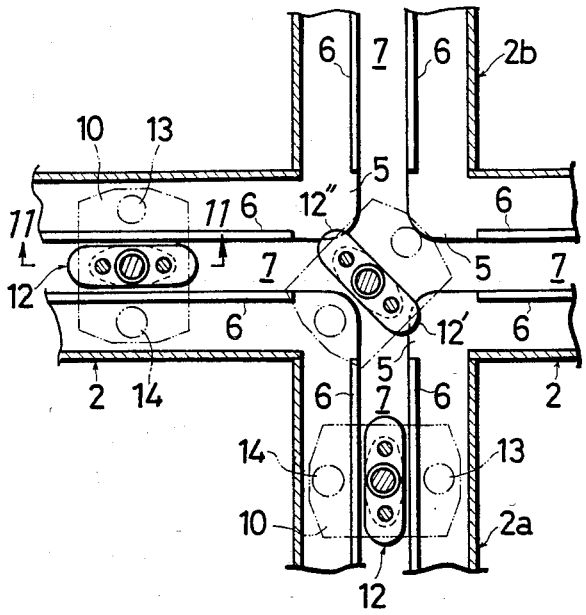
FIG. 10 is a fragmentary section taken along the line 10—10 of FIG. 6 with the rollers omitted and showing a modified runner guide.
Figure 11:
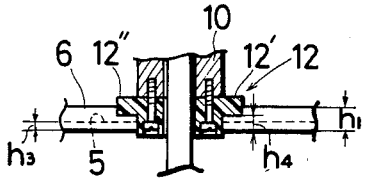
FIG. 11 is a sectional view taken along the line 11—11 of FIG. 10.
Figure 13:
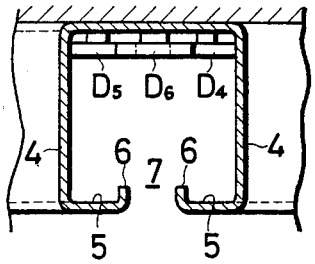
FIG. 13 is a sectional view taken along the line 13—3 of FIG. 12.
Figure 12:
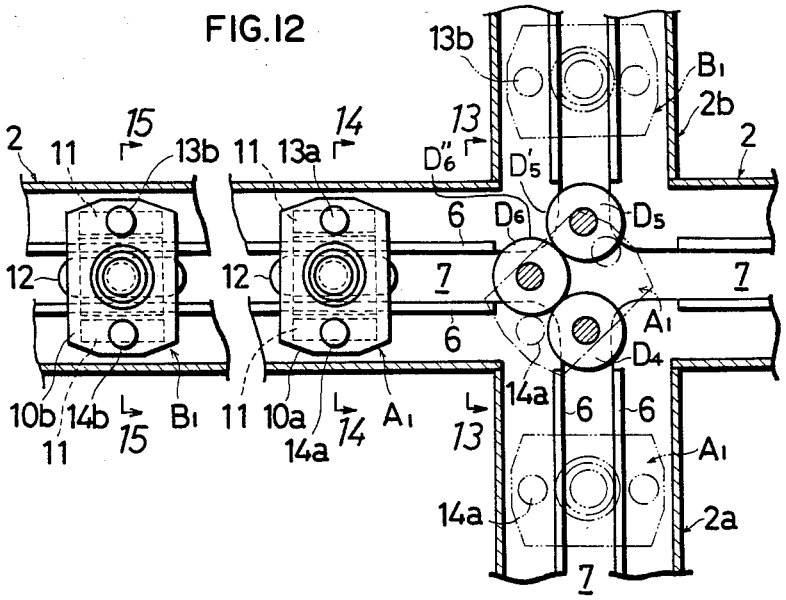
FIG. 12 is an enlarged, fragmentary top plan view, partly in section, showing a further embodiment at the criss-cross intersection.
Figure 14:
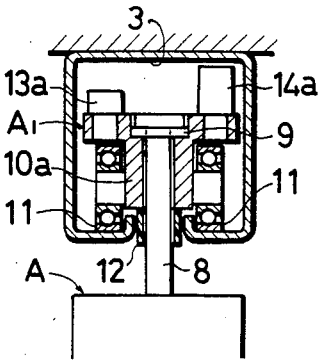
FIG. 14 is a sectional view taken along the line 14—14 of FIG. 12.
Figure 15:
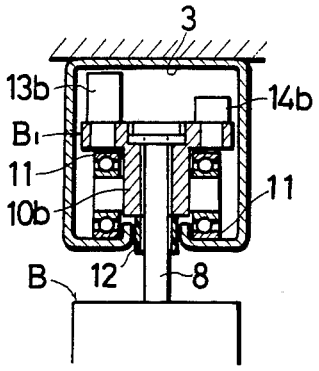
FIG. 15 is a sectional view taken along the line 15—15 of FIG. 12.

As illustrated in FIGS. 10 and 11, the left and right edges of the open passageway 7 are defined by a pair of flanges 6 each having a height $h_1$ along the straight sections of the guide tracks but the flanges 6, 6 are removed for a suitable distance at the intersection or the like leaving only the horizontal guide track 5 whose thickness is $h_3$. Also, the runner guide 12 which is of considerable length is cut to have a height $h_4$ so that the upper parts of the front 12' and rear 12'' thereof may overlap and pass through the upper surface of the horizontal guide track.

The present invention being thus described, it will be obvious that same may be varied in many ways. Such variations are not to be regarded as a departure from the spirit and scope of the invention, and all such modifications as would be obvious to one skilled in the art are intended within the scope of the following claims.

I claim:

1. A guiding system for movable suspended partition walls comprising at least one hollow main guided rail, at least two spaced, hollow branch guide rails each extending at an angle and to one side of said main guide rail, said main and branch guide rails defining at least two directional change points therebetween, each of said main and branch guide rails having a longitudinally extending open passageway on its underside, a plurality of retainers disposed within said main and branch guide rails so as to be freely movable along said open passageway, and suspending therefrom a plurality of partition walls each of which is relatively movable about a vertical suspension bar which extends upwards from each of said partition walls into said main and branch guide rails and is rotatably supported by a relevant one of said retainers, means to select directions of movement of said retainers so that selected ones only among said retainers can move from said main guide rail into one of said branch guide rails and vice versa at each of said directional change points, said means having a plurality of guide means, one of which is selectively disposed at each of said directional change points, a plurality of upstanding guided members fixedly mounted on said retainers, in such a manner that a selected one of said guided members is immovably disposed in operation and located on one side of a vertical swivel axis of each of said retainers, each of said guided members having a predetermined height that enables each of said guided members to contact only a pre-selected one of said guide means at a pre-selected one of said directional change points and freely pass underneath any other preceding one of said guide means at any preceding one of said directional change points, each of said guide means having a first guiding part fixedly mounted on said guide means which is contacted by an inner side portion, a portion adjacent to a center line of said open passageway, of a pre-selected one of said guided members, and a second guiding part fixedly mounted on said guide means which is contacted by a front portion, as viewed in a direction of advance of said retainers, of said pre-selected one of said guided members, when said pre-selected one of said guided members comes into contact with a cooperating one of said guide means, and a level of contact between said guided members and said guide means at a first one of said directional change points is higher than that at a second one of said directional change points.

2. The system as defined in claim 1, wherein at least one further branch guide rail extends at an angle from a side opposite to said one side of said main guide rail and wherein each of said retainers has a further upstanding guided member disposed on a side opposite to said one side of said vertical swivel axis.

3. The system as defined in claim 1, wherein each of said guide means comprises at least one substantially L-shaped plate-like member of a predetermined thickness.

4. The system as defined in claim 1, wherein each of said guide means is formed by a pair of roller one of which is contacted by said inner side portion of said pre-selected one of said guided members and the other of which is contacted by said front portion of said pre-selected one of said guided members.

5. The system as defined in claim 1, wherein said guided members are in the form of rollers.

6. The system as defined in claim 1, wherein each of said retainers has at its lower end a runner guide extending longitudinally in a direction of advance of the retainer, opposite sides of said runner guide facing opposite edges respectively of said longitudinally extending open passageway in said main and branch guide rails.

7. A guiding system for movable suspended partition walls comprising at least one hollow main guide rail, at least two spaced, hollow branch guide rails each extending at an angle and to one side of said main guide rail, said main and branch guide rails defining at least two directional change points therebetween, each of said main and branch guide rails having a longitudinally extending open passageway on its underside, a plurality of retainers disposed within said main and branch guide rails so as to be freely movable along said open passageway, and suspending therefrom a plurality of partition walls each of which is relatively movable about a vertical suspension bar which extends upwards from each of said partition walls into said main and branch guide rails and is rotatably supported by a relevant one of said retainers, means to select directions of movement of said retainers so that selected ones only among said retainers can move from said main guide rail into one of said branch guide rails and vice versa at each of said directional change points, said means having a plurality of guide means, one of which is selectively disposed at each of said directional change points, a plurality of upstanding guided members fixedly mounted on said retainers, in such a manner that a selected one of said guided members is immovably disposed in operation and located on one side of a vertical swivel axis of each of said retainers, each of said guided members having a predetermined height that enables each of said guided members to contact only a pre-selected one of said guide means at a pre-selected one of said directional change points and freely pass underneath any other preceding one of said guide means at any preceding one of said directional change points, each of said guide means having a first guiding part fixedly mounted on said guide means which is contacted by an inner side portion, a portion adjacent to a center line of said open passageway, of a preselected one of said guided members, and a second guiding part fixedly mounted on said guide means which is contacted by a front portion, as viewed in a direction of advance of said retainers, of said pre-selected one of said guided members, when said pre-selected one of said guided members comes into contact with a cooperating one of said guide means, a level of contact between said guided members and said guide means at a first one of said directional change points is higher than that at a second one of said directional change points, each of said retainers has at its lower end a runner guide extending longitudinally in a direction of advance of the retainer, opposite sides of said runner guide facing opposite edges respectively of said longitudinally extending open passageway in said main and branch guide rails, and said open passageway is defined between a pair of upturned flanges of said main and branch guide rails, said upturned flanges being of lesser height in each region of said directional change points and lower walls at front and rear ends of said runner guide being so shaped as to be able to pass over said edges of said open passageway at said directional change points.

* * * * *